United States Patent [19]

Bruning et al.

[11] Patent Number: 5,068,573

[45] Date of Patent: Nov. 26, 1991

[54] POWER SUPPLY WITH ENERGY STORAGE FOR IMPROVED VOLTAGE REGULATION

[75] Inventors: Gert W. Bruning, Tuckahoe; Paul R. Veldman, Mt. Kisco, both of N.Y.

[73] Assignee: North American Philips Corporation, New York, N.Y.

[21] Appl. No.: 585,574

[22] Filed: Sep. 20, 1990

[51] Int. Cl.[5] ..... H05B 41/36

[52] U.S. Cl. ..... 315/209 R; 315/224; 315/307; 315/DIG. 5; 315/DIG. 7; 363/97; 363/132

[58] Field of Search ..... 315/209 R, 209 T, 205, 315/224, 307, 352, DIG. 5, DIG. 7; 363/95, 98, 49, 37, 132, 136, 97

[56] References Cited

U.S. PATENT DOCUMENTS 4,188,660 2/1980 Knoll ..... 363/49
4,763,239 8/1988 Ball ..... 315/DIG. 7 X
4,996,462 2/1991 Krummel ..... 315/209 R

FOREIGN PATENT DOCUMENTS 0205287 3/1985 European Pat. Off. .

OTHER PUBLICATIONS

Japanese Publication 61-227579 (A).
PCT Publication WO 85/01400.

*Primary Examiner*—Eugene R. Laroche
*Assistant Examiner*—Ali Neyzari
*Attorney, Agent, or Firm*—Robert T. Mayer

[57] ABSTRACT

A power supply with energy storage means in the form of two capacitors with energy storage means provides improved voltage regulation for the power supply and also serves to store the energy contained in voltage spikes that could otherwise deleteriously effect the power supply.

6 Claims, 3 Drawing Sheets

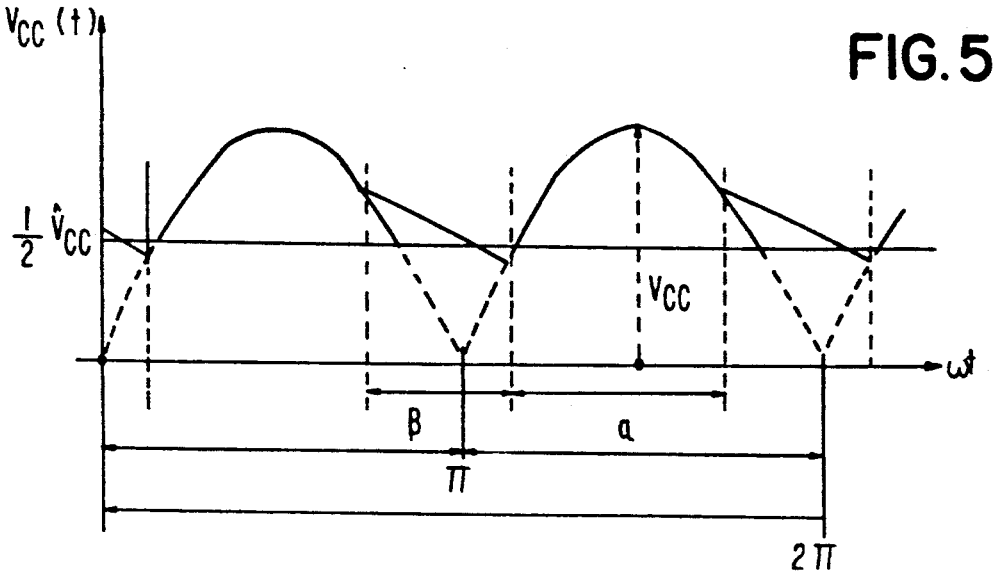
FIG. 5
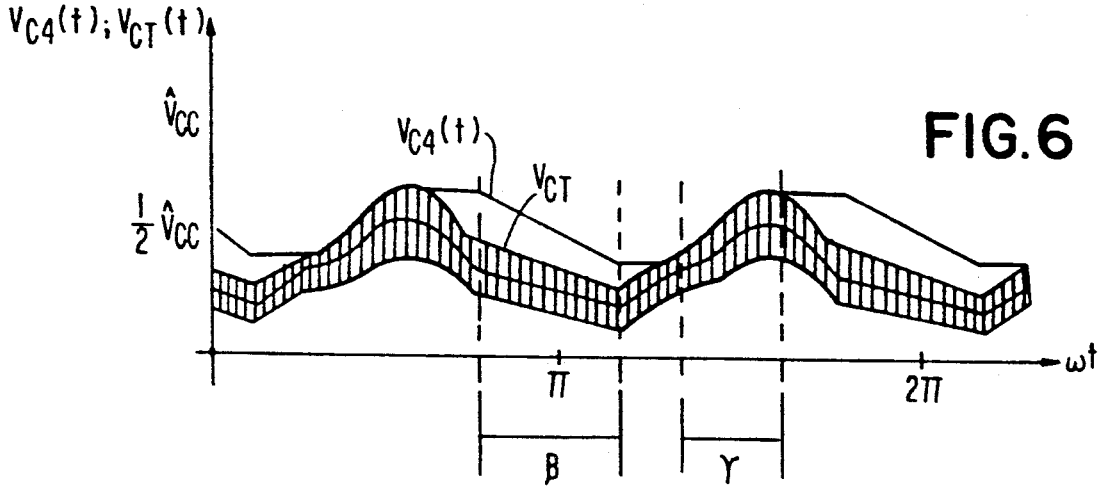
FIG. 6
FIG. 7
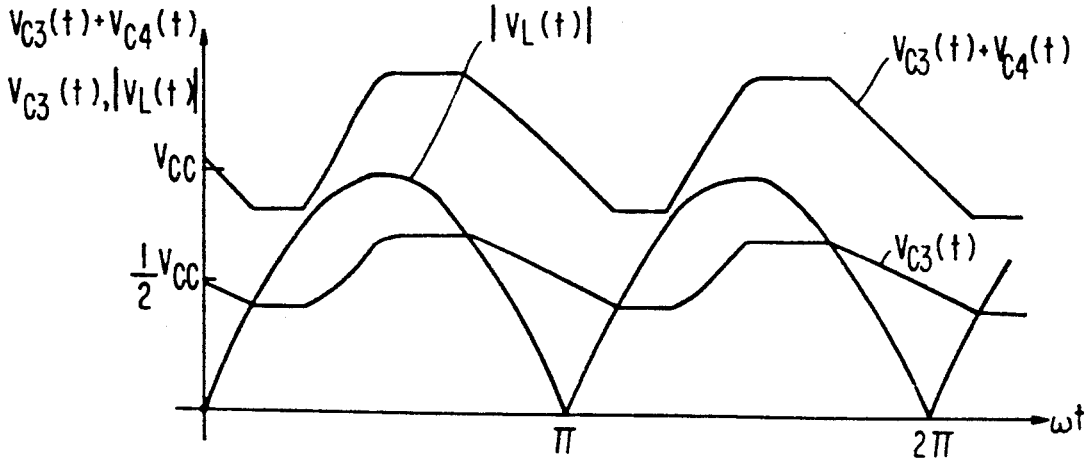

POWER SUPPLY WITH ENERGY STORAGE FOR IMPROVED VOLTAGE REGULATION

This is an invention in the electrical art. More particularly, it involves a high frequency power supply including an inverter circuit which employs an energy storage technique to improve the inverter's voltage regulation over an identical inverter which does not employ the energy storage technique.

Inverter circuits have been well known for years for use for various purposes. Recently half bridge inverter circuits have been employed to provide high frequency power to fluorescent and other gas discharge lamps. Prior gaseous discharge lamp inverter circuits suffer from inherent drawbacks. Typically, they employ a large electrolytic capacitor directly across the output of a standard type of bridge rectifier. This practice produces a very poor power factor. However, it does provide for the storage of the energy of high voltage transients which the inverter circuit might be subjected to from the power lines.

It is an object of this invention to provide an improved inverter circuit which provides both satisfactory voltage regulation and an improved power factor.

It is another object of the invention to provide an improved inverter circuit which absorbs voltage spikes which might enter the inverter circuit from the power lines.

One of the features of the invention is that the energy storage equipment is simple and relatively inexpensive.

Another feature of the invention is that the energy storage equipment receives the energy it stores through the current the inverter provides to its load circuit. Moreover, because of this unique connection of the energy storage equipment in the inverter circuit, the equipment is not subject to large repetitive charging currents as experienced in energy storage apparatus used in previous attempts to provide volta regulation in inverter circuits.

In accordance with one aspect of the invention, there is provided a voltage regulated power supply for a load circuit. The power supply includes two circuit lines and a source of full wave rectified pulsating positive voltage connected across the two circuit lines. A bridge inverter is also connected across the two circuit lines. The bridge inverter supplies high frequency current to the load circuit in response to the applied pulsating voltage. The load circuit is connected between the two circuit lines and conducts a load current in accordance with said high frequency current. One of the circuit lines operates as the positive voltage line for the load circuit and the other circuit line operates as the return line between the load circuit and the bridge inverter. An energy storage means is connected in series circuit with the load circuit. The energy storage means receives the load current and stores energy in accordance therewith. The energy storage means provides energy to the positive voltage line whenever the pulsating positive voltage decreases below a predetermined minimum whereby the voltage on the positive voltage line is regulated by the energy stored in the energy storage means as a result of the load current received thereby.

Other objects, feature and advantages of the invention will be apparent from the following description and appended claims when considered in conjunction with the accompanying drawing in which:

FIGS. 4*a*–4*d* show some of the voltage waveforms generated across some of the components of the disclosed inverter during a transient period of its operation; and FIGS. 5, 6 and 7 show various voltage waveforms generated in the inverter during its steady state period of operation.

Figure 1:
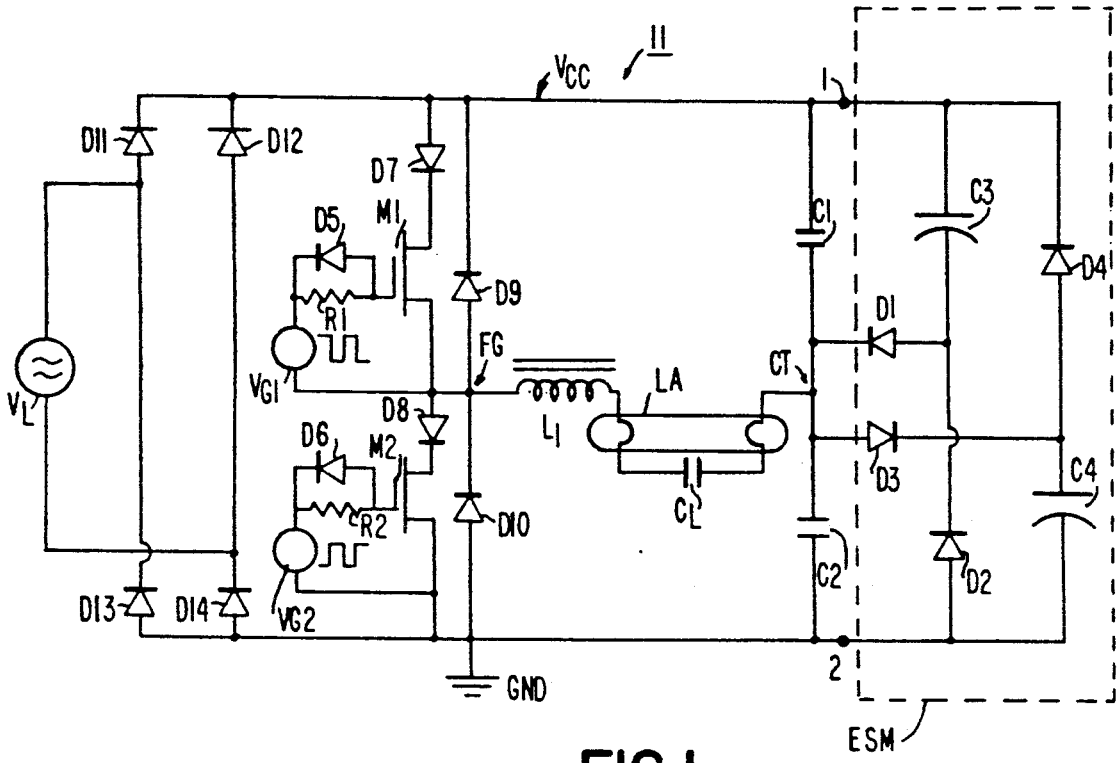
FIG. 1 is a schematic wiring diagram of a representative bridge circuit incorporating the disclosed invention.

Referring to FIG. 1 there is shown a voltage regulated power supply 11 including a full wave rectifier bridge formed by diodes D11, D12, D13 and D14. The full wave rectifier receives a representative 120 Volt, 60 Hertz signal from source $V_L$ and produces a full wave rectified pulsating positive voltage in response. Other standard voltage sources known to those skilled in the art would also be suitable. The output of the full wave bridge is applied across two power devices represented in FIG. 1 by MOSFETs M1 and M2 which form a half bridge inverter. MOSFET M1 has a series diode D7 and a parallel diode D9 connected to it. MOSFET M2 also has a series diode D8 and a parallel diode D10 connected to it. Each MOSFET also has a drive circuit connected to its control electrode, pulse generator $V_{G1}$, resistor R1 and diode D5 for MOSFET M1 and pulse generator $V_{G2}$, resistor R2 and diode D6 for MOSFET M2. Pulse generators $V_{G1}$ and $V_{G2}$, as is well known, provide out of phase square waves for the control electrodes of MOSFETs M1 and M2 to cause them to operate at a nominal 50 percent duty cycle out of phase with each other. As is typical the frequency of such out of phase signals is in the order of 30 KHz as opposed to the 60 Hertz signal from source $V_L$. Other relative high frequencies could also be used.

The load circuit for the inverter comprises a series inductor $L_1$ and a parallel connected combination of a starting capacitor $C_L$ and a discharge lamp LA connected to the starting capacitor through its filaments. It is to be understood that other load circuits could also be connected to the power supply. The load circuit is connected between nodes FG and CT of the inverter. Capacitor C1 connects node CT to circuit line $V_{cc}$ while capacitor C2 connects node CT to ground or return line GND. Connected across capacitor C1 and capacitor C2 is energy storage means ESM of the invention. More specifically connected across capacitor C1 are parallel circuits comprising series connected rectifier D1 and capacitor C3 and series connected rectifiers D3 and D4. Connected across capacitor C2 are parallel circuits comprising series connected rectifier D3 and capacitor C4 and series connected rectifiers D1 and D2.

The operation of the circuitry of FIG. 1 will be described as if the energy storage means ESM is not connected to the rest of the circuitry. Assume capacitors C1 and C2 are of equal capacitance of such magnitude that they and the resistance of the load provide a time constant which is small compared to the period of the line voltage from source $V_L$ Under such circumstances the voltage applied to the load between circuit line $V_{cc}$ and circuit line GND would be a virtual copy of the full wave rectified voltage shown as absolute value $|V_L(t)|$ in FIG. 7. As those skilled in the art will understand the power delivered to the load near the zero crossings of the line voltage would be very small under these conditions. Moreover, if a voltage spike enters the circuit as a result of lightning or a nearby switched power line the voltage on line $V_{cc}$ could increase to a value which could be destructive to the MOSFET switches M1 and M2 or to other components of the circuitry because of the low energy storage capacity of capacitors C1 and C2.

Alternatively capacitors C1 and C2 could have relatively large capacitances. Under these circumstances the voltage on line $V_{cc}$ would look like a substantially constant DC signal. The disadvantage of such an arrangement is that the charges on capacitors C1 and C2 would virtually cut off conduction from the rectified line for most of each half cycle of the full wave rectified voltage from source $V_L$ resulting in a poor power factor for the bridge and its load. Such a poor power factor would be unacceptable to power companies because the low watts to volt-amps ratio leads to uneconomical use of power lines.

The improvement disclosed herein connects the energy storage means ESM shown in FIG. 1 in the manner illustrated in FIG. 1 to the half bridge inverter circuit shown in FIG. 1. FIGS. 4*a* through 4*d* show the transient voltages across capacitor C1, C2, C3 and C4 during three transient cycles of the signals generated by drive circuit generators $V_{G1}$ and $V_{G2}$. These cycles are representative of three cycles beginning at the start of a charging period such as, $\gamma$ (gamma), of FIG. 6 except that the $\gamma$ (gamma) period assumed for this explanation is at the beginning of attempting to ignite lamp LA and that of FIG. 6 is a $\gamma$ (gamma) period after lamp LA of FIG. 1 has been turned on.

Capacitors C1 and C2 are chosen so as to be nominally equal in magnitude. As will be understood, the voltage across them must always be equal to the voltage at line $V_{cc}$ with respect to line GND.

Figure 4A:
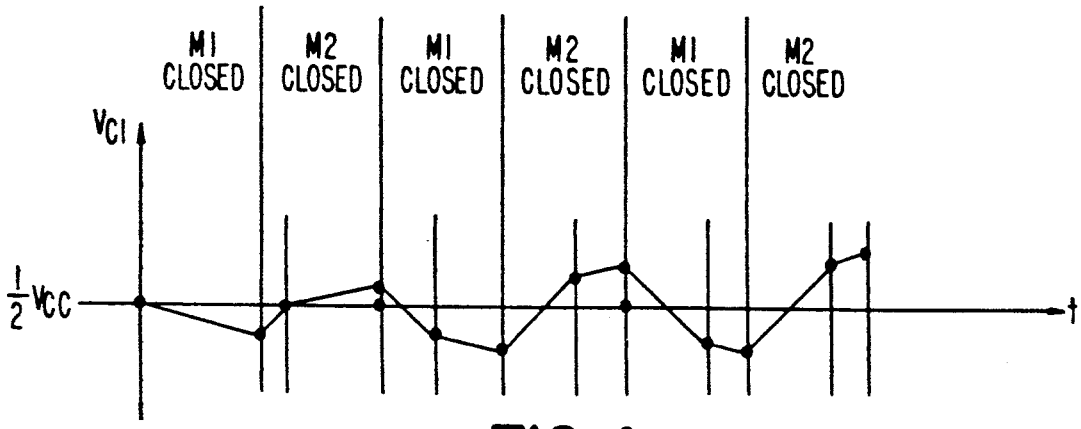
Figure 4B:
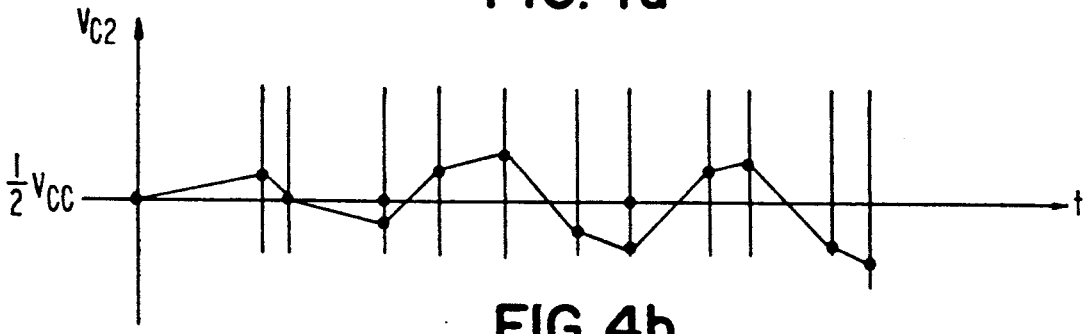

For the purposes of explanation, it is assumed that equal voltages exist across capacitor C1 and capacitor C2 at the time switch M1 first closes during the period $\gamma$ (gamma). FIGS. 4*a* and 4*b* represent this condition at the beginning of time on the ordinate axis of each figure. Assume that when switch M1 closes half the voltage on line $V_{cc}$ from source $V_L$ is stored on each of capacitors C1 and C2 and current flows from line $V_{cc}$ through switch M1 through the lamp load and through capacitor C2 to line GND. Thus for the period of time when switch M1 is closed capacitor C2 charges and reaches a slightly more positive voltage from node CT to line GND than $\frac{1}{2}V_{cc}$. At the same time capacitor C1 has to lose the same amount of voltage from line $V_{cc}$ to node CT in order that the total voltage across capacitors C1 and C2 equals the voltage from line $V_{cc}$ to line GND.

Next after switch M1 opens and switch M2 closes current flows from line $V_{cc}$ through capacitor C1 through the lamp load and through switch M2 to line GND. During this period the value of the voltage along line $V_{cc}$ is higher than the decreased voltage on capacitor C1. Capacitor C1 rapidly charges back to its initial condition. During the remaining portion of time that switch M2 is closed capacitor C1 charges positively with respect to node CT to provide a positive voltage between line $V_{cc}$ and node CT. The voltage on capacitor C2 follows that on capacitor C1 except that it is 180° out of phase therewith. This rapid charging and discharging of capacitors C1 and C2 continues during the three cycles of operation of the inverter circuit shown in FIGS. 4*a* and 4*b*.

Figure 4C:
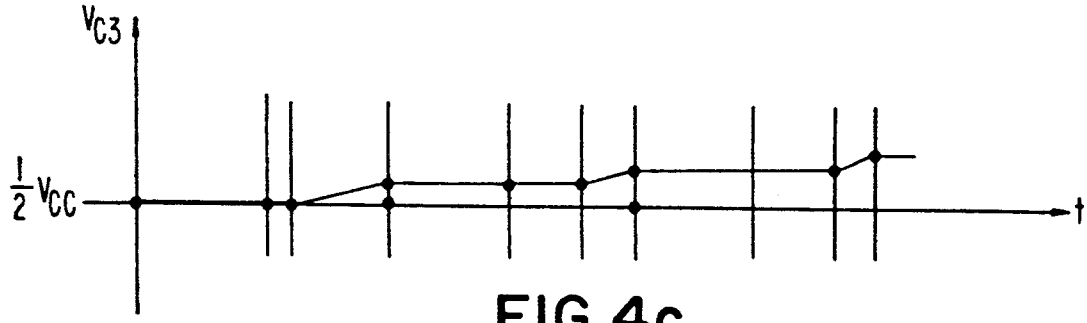
Figure 4D:
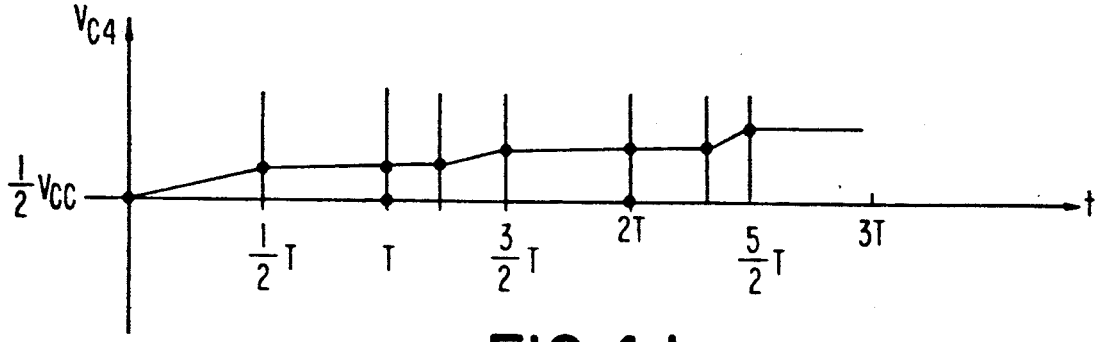

As those skilled in the art will understand, capacitors C3 and C4 are selected to be nominally equal in capacitive value and many times larger in value than capacitors C1 and C2. Capacitors C3 and C4 are connected in parallel with capacitors C1 and C2, respectively, and in series circuits with diodes D1 and D3, respectively. Diodes D1 and D3 insure that capacitors C3 and C4 are charged by the lamp load current. Starting at the abscissa of FIGS. 4*c* and 4*d* when switch M1 first closes, as described above, C4 is charged in approximately the same manner as capacitor C2 is charged except for the voltage drop across diode D3. Because diode D1 is in series with capacitor C3, capacitor C3 does not lose charge as does capacitor C1 while capacitor C2 charges positively. The charge on capacitor C3, therefore, remains constant as shown in FIG. 4*c*.

When switch M2 first closes, as described above, capacitor C2 can discharge because it is connected to node CT and to lamp LA to line GND. Capacitor C4 however does not discharge like capacitor C2 (see FIG. 4*d*), first because it is blocked by diode D3 from node CT. In addition, capacitor C4 will not discharge through line $V_{cc}$ because as assumed, the voltage on line $V_{cc}$ is higher than that on capacitor C4. Moreover, capacitor C3 in parallel with capacitor C1 is charged in the process of equalizing the voltages across both capacitors C1 and C2. This continuous charging of capacitors C3 and C4 continues until a repetitively occurring condition is the similar horizontal portion of $V_{C4}(t)$ in FIG. 7.) This charging of capacitors C3 and C4 takes place during the entire period $\gamma$ (gamma) shown in FIG. 6 during each half cycle of the voltage from voltage source $V_L$. After each period $\gamma$ (gamma) capacitors C3 and C4 remain in their fully charged condition until the voltage on line $V_{cc}$ decreases below the voltage on capacitors C3 and C4.

Various waveforms for voltages at various locations in the circuitry of FIG. 1 are shown on FIGS. 5, 6 and 7. FIG. 5 is a representative waveform for the voltage at line $V_{cc}$ with respect to line GND as a function of time. The portion $\beta$ (beta) in FIG. 5 represents the time in a cycle of the voltage on line $V_{cc}$ when capacitors C3 and C4 discharge into line $V_{cc}$ (as will be described later). The portion of the waveform identified by the letter $\alpha$ (alpha) in FIG. 5 represents the period during which line voltage from source $V_L$ provides current for the lamp load. The larger the period $\alpha$ (alpha), generally speaking, the better the power factor of the circuit. However, as those skilled in the art will understand, some practical limitations with respect to improving the power factor in this respect are to be considered. Beyond a certain point if $\alpha$ (alpha) gets excessively large the inverter operation gets closer to that described above where the energy storage means ESM was not provided and the power delivered to the load becomes relatively small at the zero crossings of the line voltage from source $V_L$.

At some time during every half cycle of the voltage from source $V_L$, the pulsating voltage on line $V_{cc}$ from the full wave rectifier formed by diodes D11–D14 will decrease below that stored on each of capacitors C3 and C4. See, for example, the beginning of the period $\beta$ (beta) on FIGS. 5 and 6. At that time, capacitors C3 and C4 are connected in parallel by reason of diodes D2 and D4 and start to supply power to lamp LA and continue to do so for the duration of period $\beta$ (beta).

As can be seen from FIGS. 5, 6 and 7, the charge on capacitors C3 and C4 does not increase immediately after the lamp LA load begins to draw power from the line each half cycle of the voltage from source $V_L$. The voltage on node CT at such times is less than the voltage on either capacitor C3 or C4 and until the voltage at node CT increases beyond the voltage on either capacitor C3 or C4, neither of these capacitors has charge added to it nor does either lose charge to the system.

The hatched portion of FIG. 6 represents the high frequency ripple voltage associated with the charging and discharging of capacitors C1 and C2 during a cycle of the voltage from source $V_L$ after the lamp has been lighted long enough for the ripple voltage to repeat in the same manner each cycle.

It is to be understood that capacitors C3 and C4 are also connected in series through diodes D1 and D3 so that their total energy storage characteristics can be used to store the energy contained in voltage spikes on line $V_{cc}$ in excess of the sum of voltages on capacitors C3 and C4 plus the voltage drops across diodes D1 and D3 due to adverse conditions such as motor starting spikes or lightning.

It is also to be understood that during the charging of the energy storage capacitors C3 and C4 the load circuit of lamp LA is always in the charging circuit. The charging of capacitors C3 and C4 is partially controlled by the ripple voltage. Also, the amount of charge held by capacitors C3 and C4 is partially controlled by the ripple current of capacitors C1 and C2 during their charging and discharging periods at the high frequency of commutation provided by sources $V_{G1}$ and $V_{G2}$.

It is to be understood that the circuit arrangement of capacitors C1 and C2 with energy storage means ESM of FIG. 1 provides a symmetrical operation and effectively reduces direct current components from flowing in lamp LA. This generally increases the efficacy of the lamp by increasing its light output for the same power beyond what the same lamp might produce with other known half bridge circuits with a different arrangement of an energy storage means. Further improved operation is provided when capacitors C3 and C4 are nominally equal; capacitors C1 and C2 are nominally equal; diodes D1 and D3 are nominally equal and diodes D2 and D4 are nominally equal.

Figure 2:
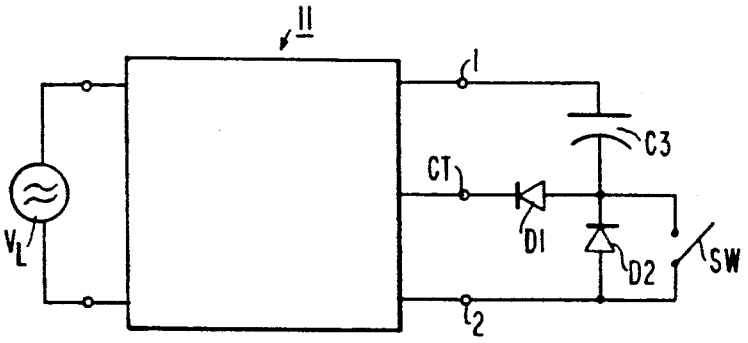
FIG. 2 is a block diagram of an alternate embodiment of a bridge circuit incorporating the disclosed invention.
Figure 3:
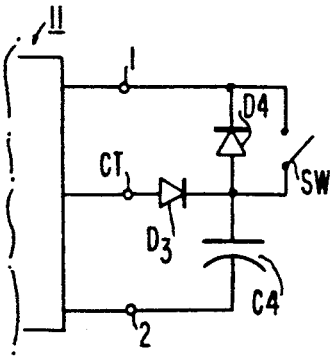
FIG. 3 is another alternate embodiment of a bridge circuit incorporating the disclosed invention.

FIGS. 2 and 3 show variations of the energy storage means of FIG. 1. In each of these embodiments only one half of the energy storage means of FIG. 1 is employed. FIG. 2 uses the capacitor C3 half of the energy storage means of FIG. 1 and employs the same reference characters for the other components (diodes D1 and D2) of that half to show the similarity between the circuits of FIG. 1 and FIG. 2. FIG. 3 employs the capacitor C4 half of energy storage means ESM of FIG. 1 together with diodes D3 and D4. Otherwise, the circuitry of FIGS. 2 and 3 is the same as that of FIG. 1. However, whereas the circuitry of FIG. 1 operates in a symmetrical mode it is to be understood that the circuitry of FIGS. 2 and 3 would operate in an asymmetrical mode.

Changes in the components of FIGS. 2 and 3 would also be necessary in order to have the circuits in those figures operate in the same manner as the circuitry of FIG. 1. In this respect capacitor C3 of FIG. 2 and capacitor C4 of FIG. 3 would have to be about twice the voltage rating of capacitors C3 and C4 if the same spike absorption protection were to be provided. In addition a voltage sensitive switch SW (shown representatively as a mechanical device although preferably a solid state device, such as a thyristor would be used) would be provided to the circuitry to bypass diode D2 of FIG. 2 and diode D4 of FIG. 3 in order to transmit such spikes to ground. To provide the same energy storage as in the FIG. 1 arrangement capacitors C3 and C4 in the FIG. 2 and FIG. 3 arrangements would also have to be about twice the capacitance of those same capacitors in the FIG. 1 arrangement.

It is further to be understood that either capacitor C1 or capacitor C2 could be eliminated from the FIG. 1 arrangement without rendering it inoperative. Moreover, by selecting capacitors C3 and C4 to be unequal the DC component of the current through lamp LA can be controlled.

It should be apparent that various modifications of the above will be evident to those skilled in the art and that the arrangement described herein is for illustrative purposes and is not to be considered restrictive.

What is claimed is:

1. A voltage regulated power supply including two circuit lines and a source of full wave rectified pulsating positive voltage connected across said two circuit lines, a bridge inverter connected between said two circuit lines, said bridge inverter supplying high frequency current to said circuit lines in response to said pulsating positive voltage across said two circuit lines, a load circuit connected between said two circuit lines and conducting a load current in accordance with said high frequency current, one of said circuit lines operating as a positive voltage line for said load circuit and the other circuit line operating as a return line between said load circuit and said bridge inverter and an energy storage means connected in series circuit with said load circuit, said energy storage means receiving said load current and storing energy in accordance therewith, said energy storage means providing energy to said positive voltage line whenever the pulsating positive voltage decreases below a predetermined minimum whereby the voltage on the positive voltage line is regulated by the energy stored in the energy storage means as a result of the load current received thereby and also including a first capacitor connected between said positive voltage line and one end of said load circuit, said first capacitor and said load circuit forming a node at the connection between them, and wherein said energy storage means includes a second capacitor and a first diode being connected in series with each other and forming a connection therebetween and being connected in parallel across said first capacitor, said first diode being poled to prevent current flow from said node directly to said second capacitor and a second diode connected from the connection between said second capacitor and said first diode to said return line and being poled to prevent current flow through said second capacitor directly to said return line.

2. A voltage regulated power supply including two circuit lines and a source of full wave rectified pulsating positive voltage connected across said two circuit lines, a bridge inverter connected between said two circuit lines, said bridge inverter supplying high frequency current to said circuit lines in response to said pulsating positive voltage across said two circuit lines, a load circuit connected between said two circuit lines and conducting a load current in accordance with said high frequency current, one of said circuit lines operating as a positive voltage line for said load circuit and the other circuit line operating as a return line between said load circuit and said bridge inverter and an energy storage means connected in series circuit with said load circuit, said energy storage means receiving said load current and storing energy in accordance therewith, said energy storage means providing energy to said positive voltage line whenever the pulsating positive voltage decreases below a predetermined minimum whereby the voltage on the positive voltage line is regulated by the energy stored in the energy storage means as a result of the load current received thereby and also including a first capacitor connected between said return line and one end of said load circuit, said first capacitor and said load circuit forming a node at the connection between them, and wherein said energy storage means includes a second capacitor and a first diode being connected in series with each other and forming a circuit connection therebetween and being connected in parallel across said first capacitor, said first diode being poled to prevent current from flowing directly from said second capacitor to said node, and a second diode connected from said circuit connection to said positive voltage line and poled to prevent current flow from said positive voltage line directly through said second capacitor.

3. A voltage regulated power supply as claimed in either claim 1 or 2, including voltage sensitive switch means connected in parallel with said second diode in order to enable said energy storage means to store the energy contained in voltage spikes which may appear on said positive voltage line.

4. A voltage regulated power supply including two circuit lines and a source of full wave rectified pulsating positive voltage connected across said two circuit lines, a bridge inverter connected between said two circuit lines, said bridge inverter supplying high frequency current to said circuit lines in response to said pulsating positive voltage across said two circuit lines, a load circuit connected between said two circuit lines and conducting a load current in accordance with said high frequency current, one of said circuit lines operating as a positive voltage line for said load circuit and the other circuit line operating as a return line between said load circuit and said bridge inverter and an energy storage means connected in series circuit with said load circuit, said energy storage means receiving said load current and storing energy in accordance therewith, said energy storage means providing energy to said positive voltage line whenever the pulsating positive voltage decreases below a predetermined minimum whereby the voltage on the positive voltage lines is regulated by the energy stored in the energy storage means as a result of the load current received thereby and also including a first and second capacitor connected in series between said positive voltage line and said return line, said first and second capacitors forming a node between them to which one end of said load circuit is connected, and wherein said energy storage means includes a third capacitor and a first diode connected in series with each other and in parallel with said first capacitor, said first diode being poled to prevent current from flowing from said node directly to said third capacitor, and a fourth capacitor and a second diode connected in series with each other and in parallel with said second capacitor, said second diode being poled to prevent current from flowing from said fourth capacitor directly to said node, said third capacitor and said fourth capacitor also being connected in parallel with said first and second capacitors, each parallel connection of said third and fourth capacitor with said first and second capacitors including a blocking diode in each of said parallel connections, each blocking diode in each of said parallel connections being poled to prevent current from flowing from said positive voltage line through said third and fourth capacitors directly to said return line, said first and second diodes connecting said third and fourth capacitors in series whereby said energy storage means functions to store the energy contained in voltage spikes which may appear on said positive voltage line.

5. A voltage regulated power supply as claimed in any one of claims 1, 2 or 4, wherein said load circuit includes a gas discharge lamp, a lamp capacitor and a lamp inductor, said gas discharge lamp being connected in parallel with said lamp capacitor both of which are connected in series with said lamp inductor, said parallel-series connection being connected between said two circuit lines.

6. A voltage regulated power supply as claimed in claim 3, wherein said load circuit includes a gas discharge lamp, a lamp capacitor and a lamp inductor, said gas discharge lamp being connected in parallel with said lamp capacitor both of which are connected in series with said lamp inductor, said parallel-series connection being connected between said two circuit lines.

* * * * *